US008985375B2

(12) United States Patent
Kohles et al.

(10) Patent No.: US 8,985,375 B2
(45) Date of Patent: Mar. 24, 2015

(54) ADJUSTABLE RACK ASSEMBLY FOR A DISHWASHER BASKET

(75) Inventors: Dieter Kohles, Markt Erlbach (DE); Gerhard Dürr, Oberasbach (DE); Klaus-Martin Forst, Zirndorf (DE)

(73) Assignee: Electrolux Home Products Corporation, N.V., Brussels (BE)

( * ) Notice: Subject to any disclaimer, the term of this patent is extended or adjusted under 35 U.S.C. 154(b) by 264 days.

(21) Appl. No.: 13/144,819

(22) PCT Filed: Feb. 10, 2010

(86) PCT No.: PCT/EP2010/000804

§ 371 (c)(1),
(2), (4) Date: Jul. 15, 2011

(87) PCT Pub. No.: WO2010/094420

PCT Pub. Date: Aug. 26, 2010

(65) Prior Publication Data

US 2011/0290804 A1 Dec. 1, 2011

(30) Foreign Application Priority Data

Feb. 10, 2009 (EP) ..... 09001808

(51) Int. Cl.
*B65D 6/08* (2006.01)
*B65D 1/34* (2006.01)
(Continued)

(52) U.S. Cl.
CPC ..... *A47L 15/503* (2013.01); *A47B 57/26* (2013.01); *A47L 15/505* (2013.01)
USPC ..... 220/488; 220/572; 211/41.8; 211/41.9

(58) Field of Classification Search
CPC ..... A47L 15/505; A47L 15/503; A47L 15/50; A47L 15/0065; A47L 15/504; A47L 15/507; A47B 57/26; A47B 57/581; A47B 57/585
USPC ..... 220/488, 487, 572; 312/311, 228.1; 211/41.8, 41.9, 175, 184, 208, 150; 134/137, 56 D, 57 D
See application file for complete search history.

(56) References Cited

U.S. PATENT DOCUMENTS 3,451,556 A 6/1969 Macoicz
3,752,322 A 8/1973 Fiocca et al.
(Continued)

FOREIGN PATENT DOCUMENTS

DE 1960802 U 5/1967
DE 7128568 U 3/1972
(Continued)

OTHER PUBLICATIONS

International Search Report from International Application No. PCT/EP2010/000804, filed Feb. 10, 2010.

*Primary Examiner* — Robert J Hicks
*Assistant Examiner* — Shawn M Braden
(74) *Attorney, Agent, or Firm* — Alston & Bird LLP

(57) ABSTRACT

An adjustable rack assembly for a dishwasher basket, comprises a rack (12) having a base bar (14) and a plurality of holding bars (16) that are fixedly attached to the base bar; and a bracket (18; 60; 80) provided at each end of the base bar for connecting said rack to a bar (10) of the dishwasher basket. The brackets (18; 60; 80) are adapted to permit horizontal shifting thereof along the bars (10) of the dishwasher basket. The rack assembly further comprises a releasable clamping means for securing the position of the brackets with respect to the bars of the dishwasher basket.

22 Claims, 5 Drawing Sheets

(51) Int. Cl.
*A47L 15/50* (2006.01)
*A47B 57/26* (2006.01)

(56) References Cited

U.S. PATENT DOCUMENTS

| | | | | |
|---|---|---|---|---|
| 4,917,248 | A * | 4/1990 | Friskney | 211/41.8 |
| 5,351,837 | A | 10/1994 | Smith | |
| 5,601,195 | A * | 2/1997 | Finola et al. | 211/41.8 |
| 7,140,705 | B2 * | 11/2006 | Dressendorfer et al. | 312/348.3 |
| 7,682,465 | B2 * | 3/2010 | Anderson et al. | 134/56 D |
| 8,042,559 | B2 * | 10/2011 | Choi et al. | 134/137 |
| 8,104,328 | B2 * | 1/2012 | Terentiev | 73/49.3 |
| 2006/0108298 | A1 | 5/2006 | Kim | |
| 2007/0247039 | A1 | 10/2007 | Anderson et al. | |
| 2010/0043448 | A1 * | 2/2010 | Lohmueller | 60/796 |
| 2010/0116759 | A1 * | 5/2010 | Lindgren et al. | 211/41.8 |

FOREIGN PATENT DOCUMENTS

| | | | |
|---|---|---|---|
| DE | 2232483 | A1 | 1/1973 |
| DE | 199 47 152 | A1 | 4/2001 |
| DE | 10204692 | B4 | 2/2004 |
| JP | 2000 237025 | A | 9/2000 |

* cited by examiner

ADJUSTABLE RACK ASSEMBLY FOR A DISHWASHER BASKET

CROSS REFERENCE TO RELATED APPLICATIONS

This application is a national stage application filed under 35 U.S.C. 371 of International Application No. PCT/EP2010/000804, filed Feb. 10, 2010, which claims priority from European Application No. 09001808.6, filed Feb. 10, 2009, each of which is incorporated herein in its entirety.

The present invention relates to an adjustable rack assembly for a dishwasher basket comprising a rack comprising a base bar and a plurality of holding bars, that are fixedly attached to the base bar and a bracket provided at each end of the base bar for connecting said rack to a bar of the dishwasher basket.

A dishwasher basket usually is provided with a plurality of racks for supporting a number of articles that are to be cleaned during a dishwashing operation. Such racks usually are provided with a plurality of holding bars that are arranged at fixed intervals and that are oriented in generally the same direction. Sometimes it would be desirable to vary both the location and the orientation of the rack so as to facilitate the placement of articles into the dishwasher basket which do not readily fit to the given orientation and location of the rack.

In view of the above, some attempts were made in the prior art to provide for more flexibility and variability in a dishwasher basket.

Thus, it is known from DE 102 04 692 B4 to provide in a dishwasher basket a foldable rack that can be tilted from a substantially vertical use position into a substantially horizontal non-use position in which the rack rests flat on the floor of the dishwasher basket. While the arrangement suggested in DE 102 04 692 B4 provides for further flexibility in a dishwasher basket in that a rack as it is used for holding plates during a dishwashing operation can be folded into said flat non-use position so as to provide an open space for taking up large items such as pots, such variability of the rack nevertheless is restricted to only to use or non-use of the rack, as it would be provided for also by a removable rack.

From DE 199 47 152 A1 there is known a rack which consists of a number of folding bars which are connected to a common base bar of the rack in a manner which allows tilting of either individual holding bars or of a number of holding bars about the base bar. Furthermore, also the base bars may be connected to the dishwasher basket by means of brackets which allow shifting of the base bars along bars of the dishwasher basket. The arrangement suggested in DE 199 47 152 A1, although providing for a high degree of flexibility, nevertheless is disadvantageous insofar as by such arrangement it is not possible to secure articles within the dishwasher basket in a reliable manner. In particular, while the individual holding bars all are rotatably connected to the base bars, which itself also are movably connected to bars of the dishwasher basket, no measures were taken to maintain the holding bars in a certain orientation as desired by the user. Thus, particularly during operation of the dishwasher, when water jets are directed to the articles that are arranged within the dishwasher basket there is a high risk that one or more of the holding bars changes its orientation and position within the dishwasher basket and thus the article, which should be held by such holding bar, becomes free to move within the basket. This involves a high risk of the articles being damaged during a washing operation.

From DE 7128568 U there is known a dishwasher basket wherein generally U-shaped plate holders are provided, which each comprise two legs that project upwards from the floor of the dishwasher basket as well as a horizontal connecting portion connecting the two legs. The U-shaped plateholders are connected to the dishwasher basket by means of brackets which allow shifting of said holders along the bars of the dishwasher basket. While such arrangement allows to adjust the spacing of the holders, no provisions are taken to secure the location of the brackets on the bars of the dishwasher basket so that the plateholders during use might change their position within the basket, and further, such arrangement does not provide for any non-use position of the holders forming the rack.

Furthermore, from DE 1960802 U and from DE 22 32 483 A there are known dishwasher baskets in which there is provided for foldable racks which may be secured in a plurality of angular orientations. While thus the orientation of the racks can be varied, it is not possible to change the position of the racks.

Finally, from U.S. Pat. No. 3,451,556 there is known a dishwasher basket that comprises a plurality of removable, generally U-shaped holding members, which may be attached at the dishwasher basket, when required. Since in this arrangement in the absence of a non-use position of the holding members, such holding members, when they shall not be used, have to be completely removed from the dishwasher and thus have to be stored separately until it again is intended to use such holders, such solution has proved to be impractical, because it involves the risk of the holders being lost or otherwise not available when the operator desires to use them.

In view of the above disadvantages of the prior art solutions, it is an object of the present invention to provide for an adjustable rack assembly for a dishwasher basket which allows for variable and flexible use and which nevertheless is simple in its handling and yet provides for a secure fixing of any articles that are placed onto such rack.

In an adjustable rack assembly for a dishwasher basket comprising a rack comprising a base bar and a plurality of holding bars that are fixedly attached to the base bar, and wherein a bracket is provided at each end of the base bar for connecting said rack to a bar of the dishwasher basket, in accordance with the present invention this object is solved in that the brackets are adapted to permit horizontal shifting thereof along the bars of the dishwasher basket, and wherein the rack assembly further comprises a releasable clamping means for securing the position of the brackets with respect to the bars of the dishwasher basket.

In the adjustable rack assembly in accordance with the present invention the rack can be displaced by horizontally shifting the brackets along the respective bars of the dishwasher basket, so as to alter the location of the rack within the basket. If, for example, two adjacent racks are provided in the dishwasher basket, by shifting the racks further apart from each other, the racks thus can be adapted to accommodate larger plates. Further, if a pair of two adjacent racks is provided in the dishwasher basket, each of these racks may be displaced individually or also both racks may be shifted simultaneously so as to alter the location of the pair of racks within the dishwasher basket. Since further, upon having shifted the rack into a position as desired by the user, the position of the brackets is secured by means of the releasable clamping means, unintentional displacements of the rack which could lead to a loosening or to movements of the articles that are placed onto such rack are prevented.

As used herein the term "horizontal" when used to indicate the direction of the displacement of the brackets along bars of the dishwasher basket should not be construed to be restricted to exactly the horizontal direction in the physical sense. Rather, the term "horizontal shifting" of the brackets comprises shifting of said brackets along bars that preferably are located at the bottom of the dishwasher basket or are a part thereof, wherein said bars can be arranged horizontally in a flat region of the bottom of the dishwasher basket and/or can be arranged at an angle relative to the horizontal direction in an inclined region of said bottom.

Preferred embodiments of the present invention are defined in the dependent claims.

In particular, the brackets preferably are adapted to permit tilting of the rack between a substantially vertical use position and a substantially horizontal non-use position, so as not only to allow adjustments of the position of the racks but also to permit stowing away said racks in the substantially horizontal non-use position, in which the racks rest flat on the floor of the dishwasher basket so as to provide for an enlarged space within said basket to accommodate larger items such as pots and pans.

Preferably, the rack assembly further comprises a first stop to restrict the tilting movement of the rack in the use position and a second stop to restrict the tilting movement of the rack in the non-use position. A stop for the non-use position can be provided in a simple and cost-effective manner by providing the base bar of the rack at least at one end thereof with an extension that extends beyond the bracket and which comprises at least one bend, which in the non-use position of the rack rests against the floor of the dishwasher basket.

While the releasable clamping means for securing the position of the brackets with respect to the bars of the dishwasher basket could be implemented in several ways, in accordance with a preferred embodiment of the invention, each bracket comprises a spring-biased clamp, which in a released state prevents shifting of the bracket along the bar of the dishwasher basket.

Such a spring-biased clamp preferably is formed by providing a bracket, which comprises a plurality of abutment surfaces, which in the released state of the bracket are biased towards engagement thereof with the bar of the dishwasher basket, which engagement can be loosened by resilient deformation of the bracket. Thus, since the bracket as such provides for the clamping action, the releasable clamping means is an integral part of the bracket, which thus facilitates fabrication and mounting of the bracket.

The said abutment surfaces preferably are arranged for engagement of a bar of the dishwasher basket from opposite sides thereof, wherein the engagement surfaces can be aligned by deformation of the bracket so as to loosen the clamping action and thus allow movement of the bracket along the bar, and wherein in the released state of the bracket, the engagement surfaces are out of alignment and due to the biasing action of the bracket are pressed against said bar of the dishwasher basket, so as to secure the bracket and hence the rack supported thereon at a desired position.

While such a bracket can be implemented in various ways, in a preferred embodiment of the invention the bracket comprises two substantially annular members, such as rings or short tubes, which preferably are broken on one side, so as to allow fitting thereof onto a bar of the dishwasher basket and which are arranged in a spaced relationship such that the axles of the bores of these rings or tubes extend at a slight angle to each other when the bracket is in its released state. While in the released state of the bracket each ring or tube accommodates the bar of the dishwasher basket, but is tilted with respect to such bar, the ring or tube, respectively, abuts against opposites sides of the bar along two edges of such ring or bar which are located on opposite sides of the bar as well as on opposite sides of the substantially annular member. In such an arrangement the section of the bracket, which connects the two rings or tubes is designed as a resilient member so that the rings or tubes in the released state of the bracket are tilted with respect to each other, but which allows alignment of the rings or tubes so as to allow shifting of the bracket along the bar to which the bracket is attached. Since the function of the substantially annular members is to provide for a clamping action on the bar of the dishwasher basket, it is to be understood that the term "substantially annular member" is intended to designate a component having a bore that is adapted to accommodate said bar of the dishwasher basket. While the outer shape of such "substantially annular members" thus is of little significance for its function, also the inner shape needs not to be circular. Hence, while in most cases the bore will have a substantially circular shape, it also may have a different inner shape.

In order to provide for the resiliency of the bracket, the bracket can be formed of an essentially rigid material, wherein the bracket comprises a hinge between the two rings or tubes as well as a spring element, which biases the rings or tubes into their tilted position. In an alternative preferred embodiment, the bracket as such is formed of a resilient material, which allows sufficient deformation so as to axially align the rings or tubes which accommodate the bar of the dishwasher basket and which in the clamping position due to their misalignment grip the said bar.

In an alternative embodiment for provision of the clamping means the rack is adapted to assume at least one first position causing the brackets to assume a release position in which they are free to move along the bars of the dishwasher basket, and at least one second position causing the brackets to assume a clamping position, in which movement of the brackets along the bars of the dishwasher basket is restrained. While in the first embodiment of the clamping means described above the clamping action thus is provided by the design of the bracket, in such alternative embodiment the resilient clamping action is provided for by the design of the rack. Thus whereas in the above first embodiment of the clamping means the user who wishes to adjust the rack by shifting thereof along bars of the dishwasher basket has to release the clamping action by manipulating the brackets, that is, if the brackets on both ends of the rack each comprise a spring-biased clamp, the rack only can be displaced by two-handed operation, the second embodiment of the clamping means allows a single handed adjustment of the rack. In particular, in such second embodiment the clamping action of both brackets can be released simultaneously by displacing the rack into the release position, i.e. by tilting the rack. When after displacing the rack a desired position has been reached, the rack is returned into a clamping position simply by tilting back the rack, which all can be done single handed.

In a preferred embodiment of such a rack assembly, each bracket has a recess for receiving a bar of the dishwasher basket, which recess in the release position of the bracket extends substantially parallel to said bar, and which recess in the clamping position of the bracket is biased to extend at an angle to said bar. Thus, by moving the rack from the first position into its second position, i.e. from the release position to the clamping position, the brackets are tilted with respect to the bars of the dishwasher basket on which they are mounted, so that the rack is tensed and thus tends to maintain the bracket in a tilted orientation as regards the bars of the dishwasher basket, so as to prevent movement of the brackets along such bars.

Preferably, the first position, in which the brackets assume a release position, is the substantially horizontal non-use position, and the second position, in which the brackets assume a clamping position, is the substantially vertical use position. Thus, a horizontal shifting movement of the rack is prevented as soon as the rack reaches its use position, whereas in the non-use position, when the rack rests on the floor of the dishwasher basket, the rack can be shifted along the basket.

In a preferred embodiment said biasing of the brackets is effected in that the shape and the pivot points of the base bar of the rack are selected such that the base bar in the first position is relaxed and in the second position is bent. Such an arrangement may be implemented, for example, by providing for at least three pivot points of the base bar of the rack that are not aligned to each other in combination with a corresponding shaping of the base bar of the rack, which in the relaxed state conforms to the non-aligned pivot points and which at different angular orientation of the rack provides for a tensioning of the rack, i.e. of the base bar thereof. Alternatively, the rack could be hinged in the conventional manner at its two lateral ends, but be arranged such that in the clamping position the base bar of the rack passes along a ramping surface that is provided in the dishwasher basket and which deforms and hence tensions the base bar when the rack is tilted from its release position into its clamping position.

In a further alternative embodiment of the clamping means the bracket has an essentially H-shape comprising two legs, which extend substantially vertical to the floor of the dishwasher basket, wherein a bridge connects the two legs at an intermediate position of the longitudinal extension of the legs. In such embodiment the bracket further is shaped so as to receive between the two legs at a position below the bridge a bar of the dishwasher basket, and to receive between the two legs at a position above the bridge a holding bar of the rack. By inserting the holding bar between the two legs, said legs are spread apart in the region above the bridge, which correspondingly results in said legs closing and clamping about said bar of the dishwasher basket in the region below the bridge.

In this embodiment the H-shaped bracket thus could be termed as double-rocker since each of the two legs of the bracket can be tilted like a rocker about the bridge, which thus acts as pivot point for both legs. In this manner, spreading the legs on one side of the bridge causes the legs to close on the other side of the bridge. Thus, the bracket provides for a double clamping function wherein by inserting a holding bar of the rack between the legs above the bridge so that said holding bar is clamped between two legs, the legs tend to tilt about the bridge, which thus causes a clamping action with respect to the bar of the dishwasher basket so that shifting of the rack along the dishwasher basket is prevented.

Preferably, said legs in the region above the bridge are provided with a taper in the direction of insertion of the holding bar, so as to provide for an increasing force, which tends to tilt the two legs of the bracket with respect to each other, when the holding bar is gradually inserted between the two legs.

In order to secure the rack in its use position, the bracket preferably comprises a catch to lock the holding bar in the use position of the rack, wherein such catch may be provided either on one or on both legs of the bracket.

Furthermore, in order to facilitate mounting of the rack within a dishwasher basket, but also to allow removing of the entire rack from the basket, the brackets preferably are adapted for removable mounting on the bars of the dishwasher basket.

For similar reasons the bracket preferably comprises a recess for snap-in mounting of the base bar of the rack, such as by providing the brackets with a substantially circular recess the diameter of which basically corresponds to that of the base bar and which is open on one side so as to be able to insert the base bar into the recess, which opening, however, is slightly smaller than the diameter of the base bar.

Preferably the bracket is a moulded plastic part, which thus can be fabricated as a single integral piece.

In further preferred embodiments of the present rack assembly there is provided an over-centre spring mechanism, which biases the rack into the use position or the non-use position, respectively. This can be achieved by using a rack wherein the base bar is shaped and hinged to the dishwasher basket as it is shown in DE 102 04 692 B4. In such a design the rack, in intermediate positions between the use position and the non-use position, assumes an instable position due to the fact that in the intermediate positions there is provided for a tensioning of the base bar, which tends to tilt the rack from such intermediate position into either the use position in which the holding bars are oriented substantially vertical to the floor of the dishwasher basket, or into the non-use position in which the rack lies flat on the bottom of the dishwasher basket.

Preferred embodiments of the present invention are described below by reference to the drawings in which.

Figure 1:
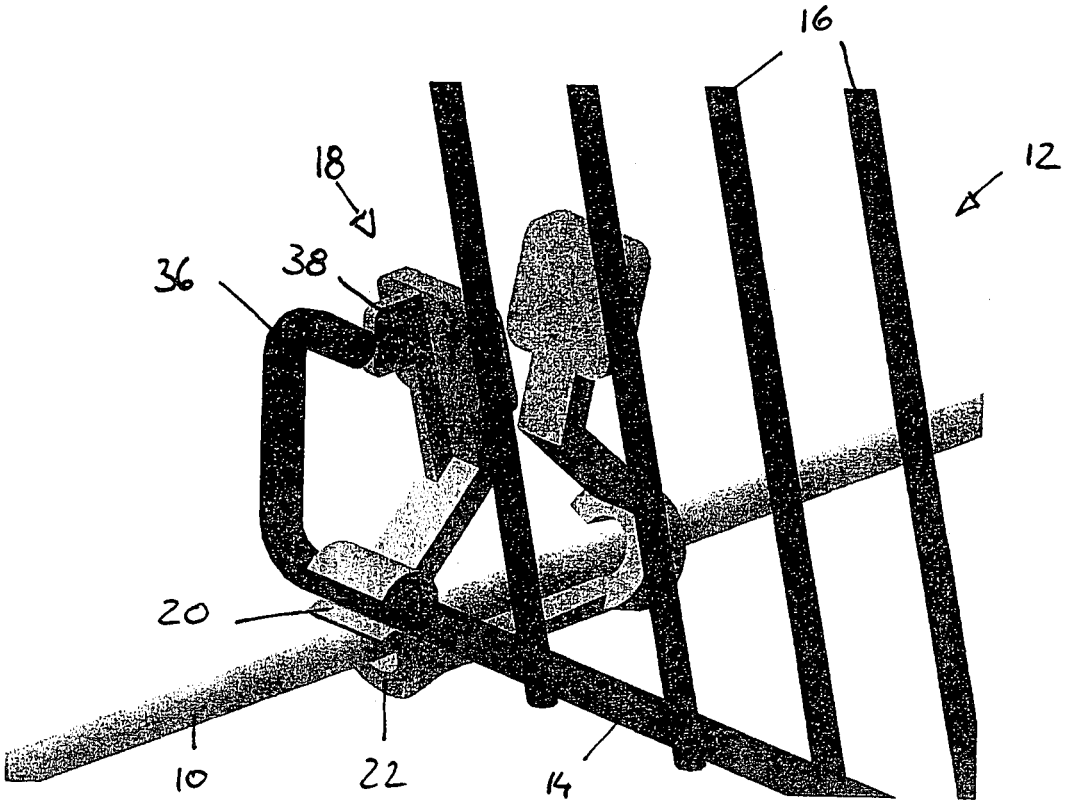
FIGS. 1 and 2 are perspective views of a first embodiment of an adjustable rack assembly in accordance with the present invention.
Figure 2:
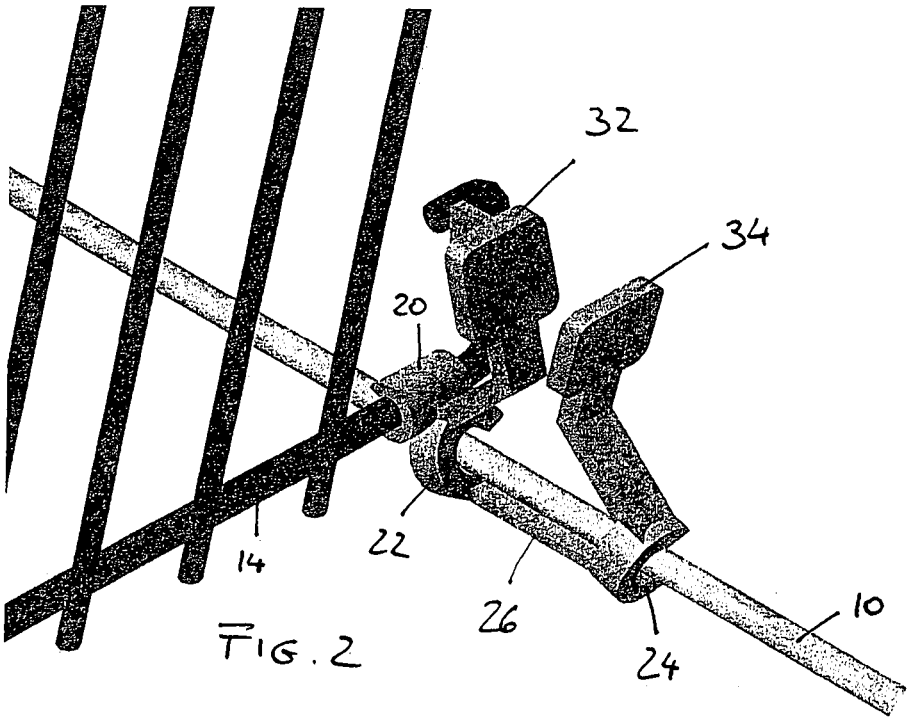
Figure 3:
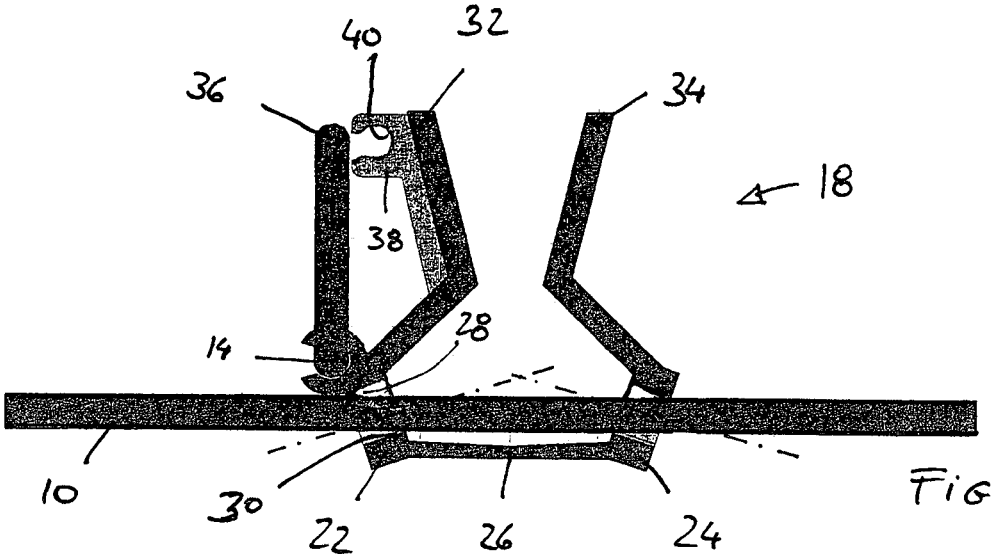
FIG. 3 is a front view of the rack assembly shown in FIGS. 1 and 2.

FIGS. 1 to 3 show a first embodiment of an adjustable rack assembly, which is intended for use in a dishwasher basket of which in FIGS. 1 to 3 there is shown a single bar 10, which extends along the bottom of a dishwasher basket, which is made up of a plurality of wire bars that are welded to each other. In a conventional dishwasher comprising an upper basket and a lower basket, the rack assembly suggested herein usually will be employed in the lower basket, in which usually larger items are placed, such as plates, pans or pots. While the dishwasher basket further to bar 10 shown in the figures will comprise a plurality of further bars, which for simplicity of illustration are not shown in the drawings, for most applications bar 10 to which the adjustable rack is attached, will be a bar which extends along one of the sidewalls of the dishwasher basket at the bottom of the basket.

The rack which in the figures generally is designated with reference sign 12 comprises a base bar 14 to which a plurality of holding bars 16 are attached, for example, by welding. As shown in the drawings, holding bars 16 may extend from the base bar 14 at an angle so as to project from the base bar substantially perpendicular to the base bar, although orienting the holding bars such that in the use position of the rack the holding bars do not extend vertically, but rather at a slight angle to the vertical axis usually is preferred.

In order to foldably connect the rack 12 to the dishwasher basket, there is provided a bracket 18, which has a sleeve 20, in which an end section of the base bar 14 of the rack 12 is received. As shown in the drawings, sleeve 20 preferably comprises a tubular section having an inner diameter that is slightly larger than the diameter of base bar 14, so that base bar 14 and hence rack 12 can be rotated within sleeve 20. To facilitate mounting of the rack at the brackets 18, sleeve 20 is provided with a slit having a width that is slightly smaller than the outer diameter of the base bar 14, so that when pressing the base bar 14 into the slit, the base bar snaps into sleeve 20.

Bracket 18 further comprises two generally ring- or tube-shaped sections 22 and 24, which also are provided with lateral slits so that the bracket can be mounted on bar 10 of the dishwasher basket, such that bar 10 extends through rings 22 and 24. As can be seen in the drawings, rings 22 and 24 are oriented such that they are both centred on bar 10, but that the axes of their central bores does not extend coaxially to bar 10, but rather extend at an angle thereto. The slanted orientation of rings 22 and 24 is maintained by a transitional section 26, which connects the two rings. It should be understood that if bracket 18, which is formed of a resilient or spring-elastic material was not mounted onto bar 10 and was fully relaxed, rings 22 and 24 would angle out even further than in the mounted state shown in FIGS. 1 to 3. Thus, due to the tilting of rings 22 and 24, these rings are biased into engagement with the bar 10. As it is shown in FIG. 3, ring 22 will engage bar 10 with the upper outer edge of its bore at 28 in FIG. 3 as well with the inner lower edge at 30 in FIG. 3. Similarly, also ring 24 is engaged with bar 10, so that in effect due to the mutual misalignment of rings 22 and 24 and bar 10, bracket 18 is fixed onto bar 10 and prevents shifting of the bracket 18 along bar 10.

In order to loosen the engagement between rings 22 and 24 and bar 10, bracket 18 is deformed so as to align the central bores of rings 22, 24 to bar 10. To facilitate deformation of bracket so as to allow shifting thereof along bar 10 of the dishwasher basket, bracket 18 is provided with two handles 32 and 34. By pressing together handles 32 and 34, the transitional section 26 which connects rings 22 and 24 is bent, so as to align rings 22 and 24 to bar 10. Although rack 12 generally could be mounted onto a dishwasher basket by the use of brackets, of which only one is designed as a clamp for securing the position of the bracket with respect to a bar of the basket, preferably clamping brackets are provided at both ends of rack 12. Therefore, a user, who wants to adjust the position of rack 12 within the dishwasher basket, presses together handles 32 and 34 of both brackets, so that rack 12 is free to move along the respective bars of the basket. When a desired position of the rack has been reached, the user simply releases the handles of the brackets so that due to the clamping action of the brackets the position of the rack in the horizontal direction again is secured. Thus by adjusting the distance of two parallel racks, the racks can be adjusted to accommodate plates of different sizes.

In case that the rack 12 shall not be used, for example, in cases where large items shall be placed into the basket, rack 12 can be tilted from the use position shown in FIGS. 1 and 2 into its non-use position, in which rack 12 rests flat on the floor of the basket by tilting the rack, when viewed in FIGS. 1 and 2, in the counter-clockwise direction.

In order to provide rack 12 with a stop which prevents the rack from tilting beyond the desired use position or the desired non-use position, respectively, base bar 14 of rack 12 in the region beyond sleeve 20 is provided with an extension that is bent twice so as to form a stop 36, which in the use position of the rack 12 abuts against an abutment surface 38 provided at handle 32 of bracket 18, and which in the non-use position of rack 12 rests on bar 10 of the dishwasher basket. As it is shown in FIG. 3, the abutment surface 38 of handle 32 further can be provided with a recess 40 wherein stop 36 snaps-in so as to lock rack 12 in its use position.

Figure 4:
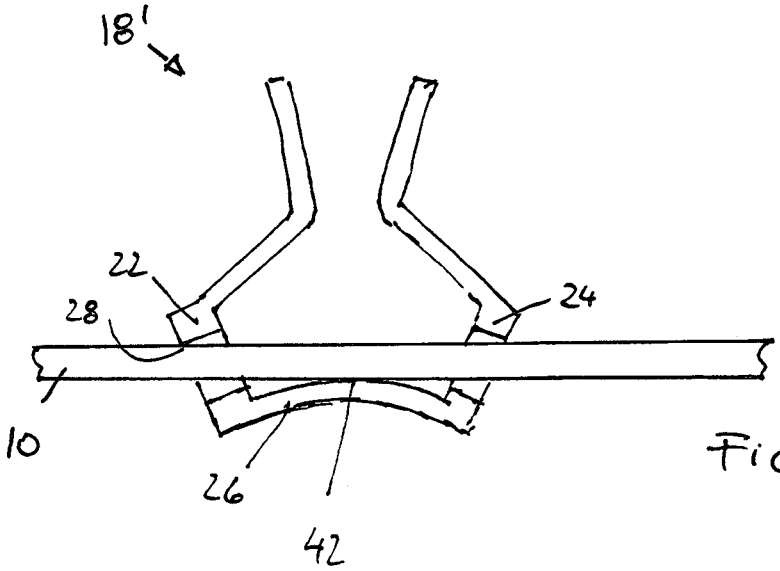
FIGS. 4 and 5 are views similar to FIG. 3 of modified embodiments of the rack assembly shown in FIGS. 1 to 3.
Figure 5:
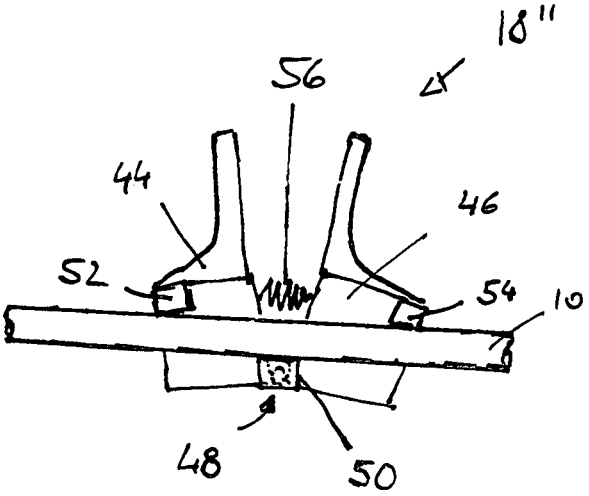

FIGS. 4 and 5 schematically depict alternative embodiments of bracket 18 shown in FIGS. 1 to 3. In particular, FIG. 4 shows a variant of bracket 18, which differs from that shown in FIGS. 1 to 3 in that in the clamping position of bracket 18' shown in FIG. 4, rings 22 and 24 rest with their upper outer, edge of the bores against the bar 10, as was also the case for bracket 18 of FIGS. 1 to 3, but at their lower inner edge 30 are spaced from bar 10. Instead, in the embodiment of FIG. 4 the clamping action is provided for by the transitional area 26 connecting rings 22 and 24, which forms an abutment surface 42, which in the clamping position rests against the underside of bar 10.

In the variant of FIG. 5 the bracket 18" is designed as a multi-part component comprising a first bracket half 44 and a second bracket half 46, which are connected to each other by means of a hinge 48, so that bracket halves 44 and 46 are connected to each other in an articulated manner. In this embodiment the clamping action onto bar 10 of the dishwasher basket is provided by three abutment elements, namely a first abutment element 50, which is provided in the region of hinge 48 as well as two further abutment elements 52 and 54 which are provided on bracket halves 44 and 46, respectively. As it is shown in FIG. 5, abutment elements 50, 52 and 54 laterally project from bracket 18 and are pressed against bar 10 due to the action of a spring element 56 which is arranged between bracket halves 44 and 46 and forces them apart. The operation of brackets 18' and 18" shown in FIGS. 4 and 5, respectively, is similar to that described in connection with the embodiment shown in FIGS. 1 to 3 and hence needs not be described again.

Figure 6:
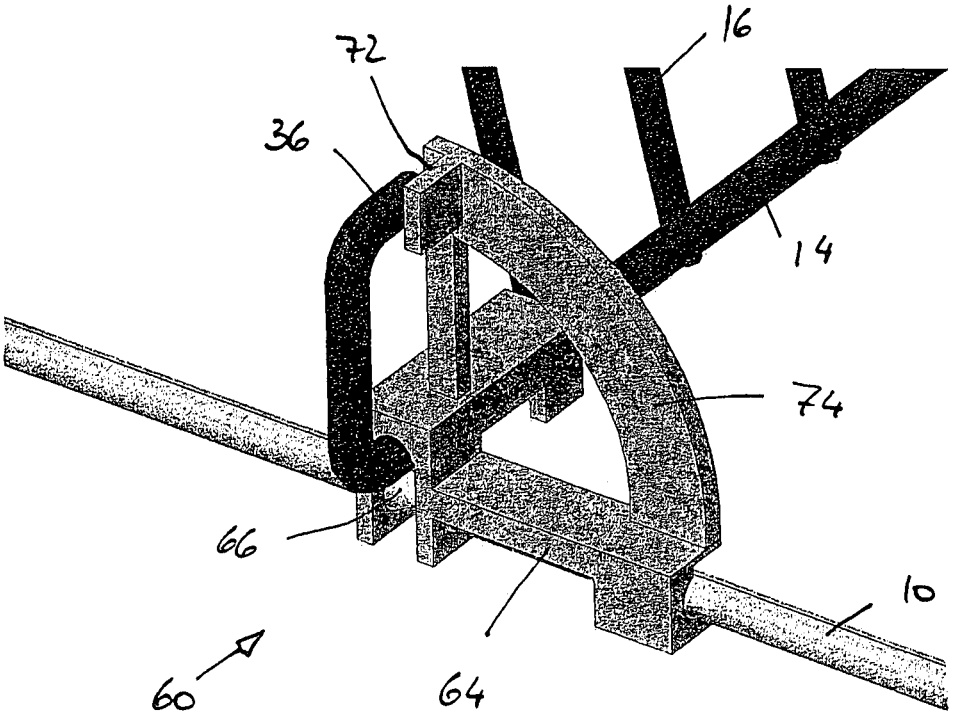
FIGS. 6 and 7 are perspective views of a rack assembly in accordance with a further embodiment of the invention.
Figure 7:
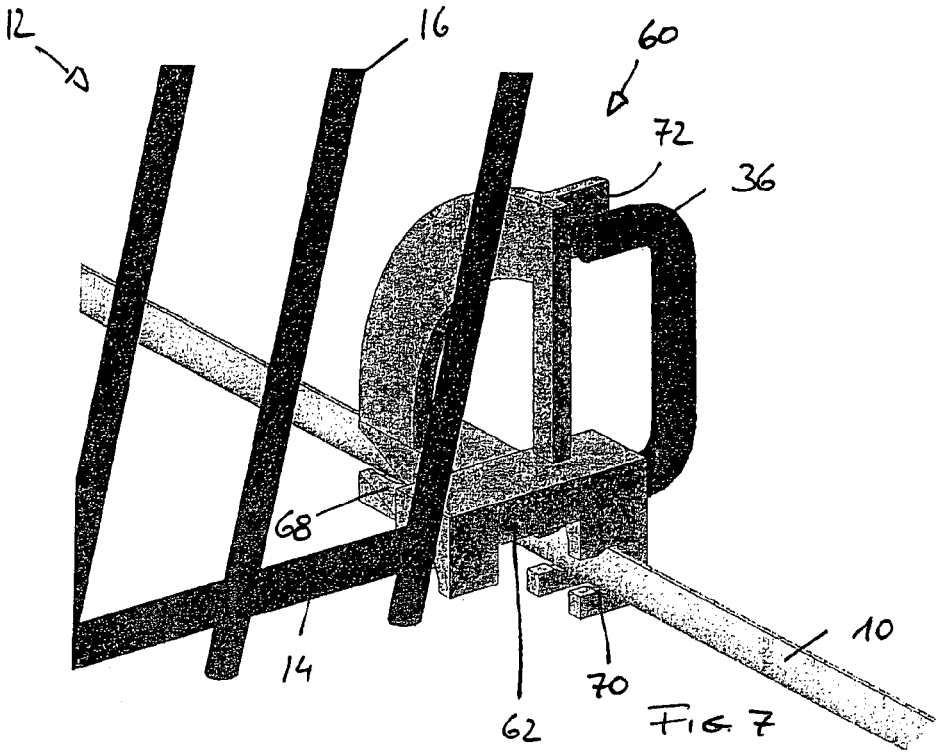

In FIGS. 6 and 7 there is shown a further embodiment of the adjustable rack assembly in which the force for effecting the clamping action, by which shifting of the brackets along the bars of the dishwasher basket is prevented, is not provided for by the brackets as such, as was the case for the embodiments shown in FIGS. 1 through 5, but wherein such force is created by the design of the rack as such.

In particular, rack 12 in this embodiment is designed such that whereas in a release position, which preferably can be the non-use position, in which the rack lies flat on the floor of the dishwasher basket, the base bar 14 of the rack extends more or less loosely through brackets 60, but in the upright use position of the rack is bent so as to slightly displace brackets 60 and thus provide for a clamping action of the brackets with respect to bar 10.

In order to provide for such a function of the rack, a rack may be used as it is shown in DE 102 04 692 B4. Thus, the rack may have a configuration wherein the base bar is not straight when relaxed and is pivotably held at the floor of the dishwasher basket at three pivot points, which are not aligned in a straight line, so that when the rack is tilted a tension is created or released, respectively in the base bar of the rack. Alternatively, the rack could be hinged only at the two brackets on either side, but additionally cooperate in its central section with a ramping surface that is provided at the floor of the dishwasher basket and which causes the base bar of the rack to bend when its is moved along the ramping surface.

As it is shown in FIGS. 6 and 7, bracket 60 has, when viewed from the top, a substantially rectangular configuration comprising a first leg 62 through which the base bar 14 of the rack extends, and a second leg 64 which accommodates bar 10 of the dishwasher basket. In order to mount rack 12 onto the dishwasher basket, rack 12 is threaded with its lateral end comprising stop 36 through a lateral opening 66 of bracket 60, into which opening a reception groove for base bar 14 terminates that is provided along the underside of first leg 62. Then bracket 60 is fitted onto bar 10 such that a slanted lateral slit 68, which is provided at the inner side of second leg 64 of bracket 60 takes up bar 10 (i.e. during that step bracket 60 has to be tilted from the position shown in FIG. 7 counter-clockwise until slit 68 extends parallel to bar 10). Upon bar 10 having passed slit 68 bracket 60 is tilted such that second leg 64 extends parallel to bar 10, so that bar 10 is located in front of snap-in openings 70 provided at the inner side of second leg 64 below the region of bracket 60 through which base bar 14 of rack 12 passes. Finally, bracket 60 is laterally pushed onto bar 10, such that bar 10 snaps into openings 70.

In the embodiment shown in FIGS. 6 and 7 the first and second legs 62 and 64 of bracket 60 are designed not to be too short so as to provide for sufficient leverage to create a clamping force of second leg 64 onto bar 10, when base bar 14 of rack 12 is bent by being tilted into its clamping position.

Similarly, as was the case for the embodiments explained by reference to FIGS. 1 to 3, also in the embodiment shown in FIGS. 6 and 7, the base bar 14 is provided with an extension that extends laterally beyond bracket 60 and is bent so as to form a stop 36, which in the non-use position of rack 12 abuts against bar 10 of the dishwasher basket and which in the use position of rack 12 abuts against a stop surface 72 of the bracket 60. In order to provide for a higher rigidity of the bracket 60, there is provided a reinforcing section 74, which connects between stop 72 and the free end of second leg 64.

Figure 8:
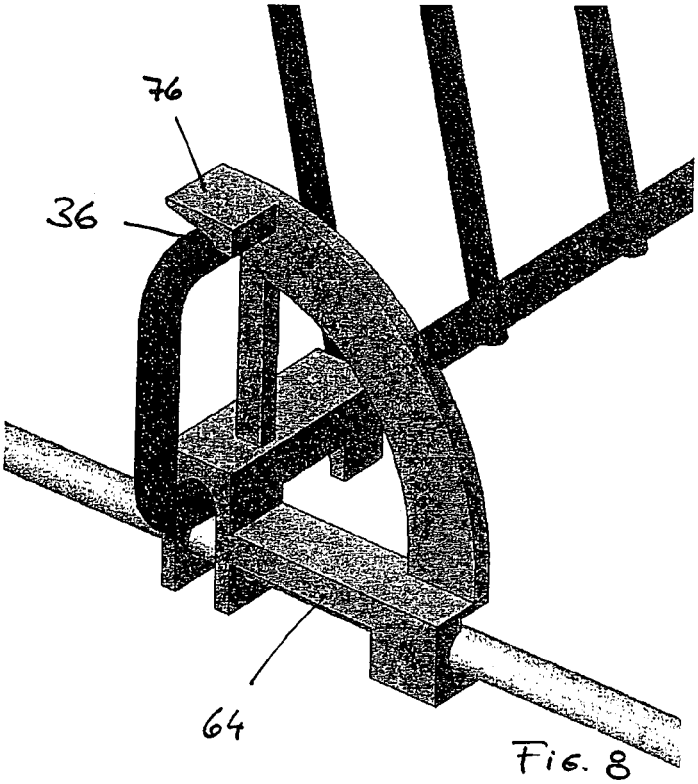
FIG. 8 is a modified embodiment of the rack assembly shown in FIGS. 6 and 7.

FIG. 8 shows a variant of the embodiment shown in FIGS. 6 and 7, which differs therefrom merely in that instead of a flat stop surface 72 there is provided a slanted stop surface 76, which is designed to exert a clamping force onto stop 36 when rack 12 has been tilted into its use position, so as to maintain the position of rack 12 during use.

Figure 9:
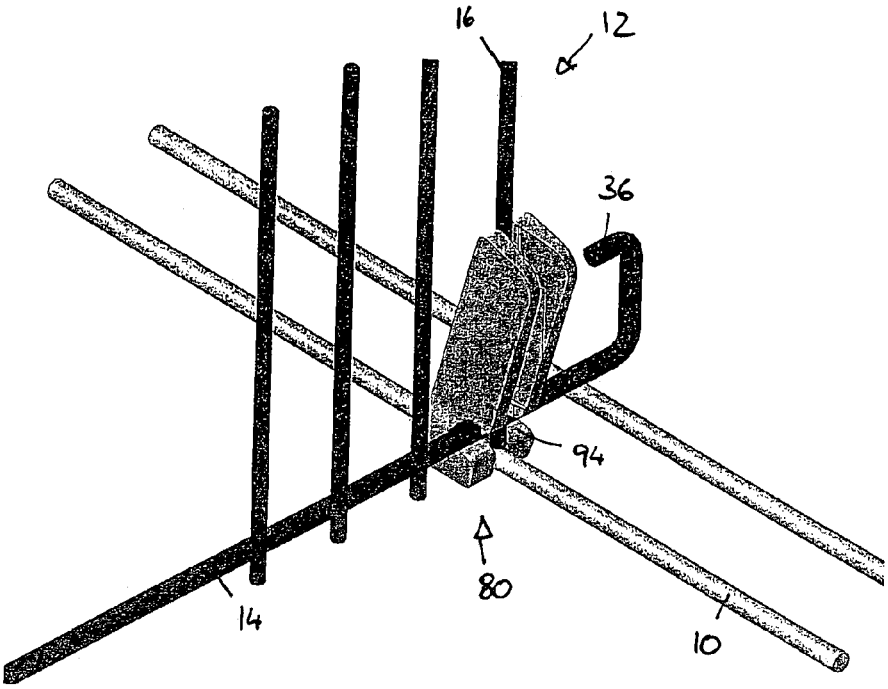
FIG. 9 is a perspective view of an alternative embodiment of a rack assembly in accordance with the present invention.
Figure 10:
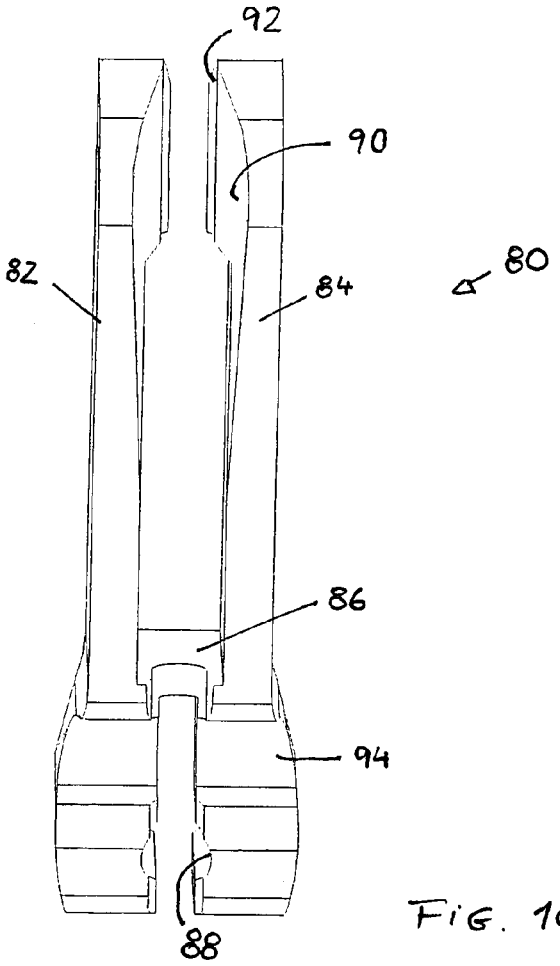
FIG. 10 is a perspective front view of only the bracket of the rack assembly shown in FIG. 9.

In FIGS. 9 and 10 there is shown a further embodiment of an adjustable rack assembly in accordance with the present invention. While also in this embodiment a clamping action is effected by interaction of the rack and the bracket, in contrast to the embodiments shown in FIGS. 6 to 8 where clamping is effected by selective misalignment of the brackets with respect to the bar of the dishwasher basket, in the embodiment of FIGS. 9 and 10 a clamping action of bracket 80 with respect to bar 10 of the dishwasher basket is effected by a deformation of the bracket, which in turn is caused by interaction of the bracket with a holding bar 16 of rack 12.

To this end, bracket 80 has an essentially H-shape comprising two legs 82 and 84, which, when the bracket is mounted, extend substantially vertically to the floor of the dishwasher basket. Legs 82 and 84 are connected by means of a bridge 86, which divides the bracket 80 in a lower section in which a bar 10 of the dishwasher basket is received and an upper section in which a holding bar 16 of rack 12 is received. Bridging section 86 grants bracket 80 a certain amount of flexibility and thus acts as a swivel so that a mutual movement of legs 82 and 84 in the upper section of bracket 80 is transmitted to the lower section so as to selectively create a clamping force or loosen the latter. In particular, bracket 80 in its lower section comprises a groove 88 in which a bar 10 of the dishwasher basket is loosely received when bracket 80 is relaxed. Thus, in the relaxed position of bracket 80 the rack 12 can be shifted along bar 10 so as to attain a position as desired by the user. When such position is reached, rack 12 is tilted fully into its use position. In doing so, a holding bar 16 of rack 12 is inserted between legs 82 and 84 of bracket 80 so that it engages legs 82 and 84 at their tapered inner faces 90, and is pushed further until holding bar 16 snaps into a recess 92 provided at the rear side of the inner faces of legs 82 and 84.

Bracket 80 is designed such that in its relaxed condition the gap provided between legs 82 and 84 is smaller than the width of holding bar 16 of rack 12. Thus, when tilting rack 12 into its use position, legs 82 and 84 of bracket 80 are spread apart. This deformation of bracket 80, which thus is designed as a double rocker about bridge 86, is transmitted to the lower section of the brackets, so that the portions of legs 82 and 84 below bridge 86 close about bar 10 and by thereby exerting a clamping force thereon prevent shifting of the bracket along bar 10.

In using the rack assembly shown in FIGS. 9 and 10, rack 12 thus can be shifted when it is in its substantially horizontal non-use position or in a any position where the rack is not fully erected along the bar 10. When the desired position is reached, the rack is erected further until the rack with its holding bars 16 snaps into the recesses 92 provided at the brackets 80, so that the rack due to the double clamping action of brackets 80 is prevented from shifting along bars 10 of the dishwasher basket and simultaneously is securely held in its use position. In case that the rack shall be completely removed from the dishwasher basket, this can be easily done by tilting the rack into its non-use position (or any intermediate position), removing the rack 12 from brackets 80 by pushing base bar 14 out of engagement with the horizontal reception groove 94 of bracket 80, which groove preferably is designed as a snap-in recess, and by pressing together legs 82 and 84 thereby disengaging the lower section of bracket 80 from bar 10, in which state bracket can be lifted and thus rack 12 can be removed from the dishwasher basket.

The invention claimed is:

1. An adjustable rack assembly for a dishwasher basket, comprising a rack comprising a base bar and a plurality of holding bars that are fixedly attached to the base bar; the base bar having a first end and a second end; and a bracket provided at each of the first and second ends of the base bar for connecting said rack to a first bar and a second bar of the dishwasher basket; wherein said brackets are further adapted to permit tilting of the rack between a substantially vertical use position and a substantially horizontal non-use position; each of said brackets comprising a releasable clamping means for securing the position of the brackets with respect to the first bar and the second bar of the dishwasher basket and adapted to permit horizontal shifting thereof along the first bar and the second bar of the dishwasher basket, wherein said releaseable clamping means each comprise at least one component having a central bore wherein one of the first or second bar passes through the central bore thereof, an axis of the central bore is configured to extend coaxially with the first or second bar to permit horizontal shifting of the bracket along the first or second bar and the axis of the central bore is configured to not extend coaxially with the first or second bar to prevent shifting of the bracket along the first or second bar.

2. The rack assembly of claim 1, further comprising a first stop to restrict the tilting movement of the rack in the use position and a second stop to restrict the tilting movement of the rack in the non-use position.

3. The rack assembly of claim 2, wherein said base bar at least at one end thereof extends beyond the bracket and comprises at least one bend which in the non- use position of the rack rests against a bar of said dishwasher basket so as to form said second stop.

4. The rack assembly of claim 1, wherein at least one of said brackets comprises a spring biased clamp which in a released state prevents shifting of the bracket along the bar of the dishwasher basket.

5. The rack assembly of claim 4, wherein said bracket comprises a plurality of abutment surfaces which in the released state of the bracket are biased towards engagement thereof with said bar of the dishwasher basket, and engagement of which with said bar of the dishwasher basket can be loosened by resilient deformation of the bracket.

6. The rack assembly of claim 5, wherein said abutment surfaces are arranged for engagement of said bar of the dishwasher basket from opposite sides, wherein said engagement surfaces can be aligned by deformation of said bracket so as to allow movement of the bracket along the bar, and wherein in the released state of the bracket the engagement surfaces are out of alignment.

7. The rack assembly of claim 4, wherein said bracket comprises two substantially annular members, which are adapted to accommodate said bar of the dishwasher basket and which are arranged in a spaced relationship such that an axle of a bore of each of said substantially annular members extend at an angle to each other when the bracket is in its released state.

8. The rack assembly of claim 4, further comprising at least one handle to facilitate deformation of said bracket.

9. The rack assembly of claim 4, wherein said bracket is formed of a resilient material.

10. The rack assembly of claim 1, wherein said rack is adapted to assume at least one first position causing the brackets to assume a release position in which they are free to move along the bars of the dishwasher basket, and at least one second position causing the brackets to assume a clamping position in which movement of the brackets along the bars of the dishwasher basket is restrained.

11. The rack assembly of claim 10, wherein each bracket has a recess for receiving a bar of the dishwasher basket, which recess in the release position of the bracket extends substantially parallel to said bar, and which recess in the clamping position of the bracket is biased to extend at an angle to said bar.

12. The rack assembly of claim 11, wherein the first position of said rack is the substantially horizontal non-use position, and said second position is the substantially vertical use position.

13. The rack assembly of claim 11, wherein said biasing of the brackets is effected in that a shape and pivot points of the base bar of the rack are selected such that when the base bar is in the at least one first position, the bracket is relaxed and when the base bar is in the at least one second position, the bracket prevents shifting of the bracket along the bar of the dishwasher basket.

14. The rack assembly of claim 1, wherein at least one of said brackets has an essentially H-shape comprising two legs which extend substantially vertical to the floor of the dishwasher basket, and a bridge connecting the two legs at an intermediate position of the longitudinal extension of the legs, wherein the bracket further is shaped so as to receive between the two legs at a position below the bridge a bar of the dishwasher basket, and to receive between the two legs at a position above the bridge a holding bar of the rack, wherein by inserting said holding bar between the two legs said legs are spread apart in the region above the bridge which results in said legs closing and clamping about said bar of the dishwasher basket.

15. The rack assembly of claim 14, wherein said legs in the region above the bridge are provided with a taper in the direction of insertion of said holding bar.

16. The rack assembly of claim 14, wherein said bracket further comprises a catch to lock the holding bar in the use position of the rack.

17. The rack assembly of claim 1, wherein said brackets are each adapted for removable mounting on at least one of the first and second bars of the dishwasher basket.

18. The rack assembly of claim 1, wherein each bracket comprises a recess for snap-in mounting of the base bar of the rack.

19. The rack assembly of claim 1, wherein each bracket is a molded plastic part.

20. The rack assembly of claim 1, further comprising an over-center spring mechanism which biases the rack into the use position or the non-use position, respectively.

21. A dishwasher basket comprising a rack as defined in claim 1.

22. A dishwasher basket comprising a rack as defined in claim 21, wherein an over-center spring mechanism is formed by selecting a shape and pivot points of the base bar of the rack such, that when the base bar is in the substantially vertical use position or the substantially horizontal non-use position the bracket is more relaxed than in any intermediate position between the substantially vertical use position and the substantially horizontal non-use position.

* * * * *